US006945525B2

(12) United States Patent
Mathewson

(10) Patent No.: US 6,945,525 B2
(45) Date of Patent: Sep. 20, 2005

(54) SHEET FEEDING APPARATUS HAVING AN ADAPTIVE AIR FLUFFER

(75) Inventor: Mark D. Mathewson, Sodus Point, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 10/304,186

(22) Filed: Nov. 25, 2002

(65) Prior Publication Data

US 2004/0100013 A1 May 27, 2004

(51) Int. Cl.[7] ..... B65H 3/14
(52) U.S. Cl. ..... 271/97
(58) Field of Search ..... 271/97, 195; 221/278; 400/627; B65H 3/14

(56) References Cited

U.S. PATENT DOCUMENTS

| | | | | | |
|---|---|---|---|---|---|
| 4,690,395 | A | * | 9/1987 | Nowicki | 271/98 |
| 5,110,110 | A | * | 5/1992 | Wirz et al. | 271/98 |
| 6,264,188 | B1 | | 7/2001 | Taylor et al. | 271/98 |
| 6,354,585 | B1 | * | 3/2002 | Takahashi | 271/97 |

* cited by examiner

*Primary Examiner*—Donald P. Walsh
*Assistant Examiner*—Kenneth W. Bower
(74) *Attorney, Agent, or Firm*—Lloyd F. Bean, II

(57) ABSTRACT

A sheet feeding apparatus for feeding a stack of sheets in a direction of movement to a process station, including: a sheet tray for holding the stack of sheets; an air plenum, positioned above the stack of sheets, for picking up a sheet from the stack of sheets when a vacuum force in the air plenum; a paper fluffer for blowing air between individual sheets in the stack, the paper fluffer having means for adjusting air flow between individual sheets.

10 Claims, 4 Drawing Sheets

SHEET FEEDING APPARATUS HAVING AN ADAPTIVE AIR FLUFFER

FIELD OF THE INVENTION

This invention relates generally to an electronic reprographic printing system, and more particularly concerns feeder apparatus process for improving feeding of compilations of recording sheets that often accompanies this general method of reproduction and printing.

BACKGROUND OF THE INVENTION

In the process of electrostatographic reproduction, a light image of an original to be copied or printed is typically recorded in the form of a latent electrostatic image upon a photosensitive member, with a subsequent rendering of the latent image visible by the application of electroscopic marking particles, commonly referred to as toner. The visual toner image can be either fixed directly upon the photosensitive member or transferred from the member to another support medium, such as a sheet of plain paper. To render this toner image permanent, the image must be "fixed" or "fused" to the paper, generally by the application of heat and pressure.

With the advent of high speed xerography reproduction machines wherein copiers or printers can produce at a rate in excess of three thousand copies per hour, the need for sheet handling system to, for example, feed paper or other media through each process station in a rapid succession in a reliable and dependable manner in order to utilize the full capabilities of the reproduction machine. These sheet handling systems must operate flawlessly to virtually eliminate risk of damaging the recording sheets and generate minimum machine shutdowns due to misfeeds or multifeeds. It is in the initial separation of the individual sheets from the media stack where the greatest number of problems occur which, in some cases, can be due to up curl and down curl in sheets which generally occur randomly in the document stack.

Applicant has found that previous approaches incorporated a venturi fluffer (U.S. Pat. No. 6,264,188 to Taylor et al.) to break apart the sheets on the stack. That patent discloses a venturi fluffer utilizing internal and external flaps in order to maintain a relatively constant throat cross section and pressure to achieve sheet separation. The venturi fluffer provided satisfactory performance in uncoated papers up to 200 gsm, slightly lower with coated stocks due to an observed lack of sufficient air pressure to break up the sheet pairs inherent in coated stocks, even with heat. The venturi fluffer provided a wide throat cross section that delivered sufficient air volume to maintain sheet separation, once achieved, but at an insufficient pressure necessary to break up sheet pairings observed during testing. Various combinations of fluffer pressure settings and configurations provided little relief across the wide range of media types prescribed.

Other high pressure fluffing systems use multiple blower pressure settings to provide the correct air flow rate and pressure into the side of a stack. All of the systems have pressure losses due to air flowing above the stack.

SUMMARY OF THE INVENTION

There is provided a sheet feeding apparatus for feeding a stack of sheets in a direction of movement to a process station, comprising: a sheet tray for holding said stack of sheets; an air plenum, positioned above said stack of sheets, for picking up a sheet from said stack of sheets when a vacuum force in said air plenum; a paper fluffer for blowing a constant volume of air at pressure between individual sheets in said stack to produce a fluffed stack of sheets, said paper fluffer having means for adjusting air pressure between individual sheets.

DETAILED DESCRIPTION OF THE INVENTION

Figure 1:
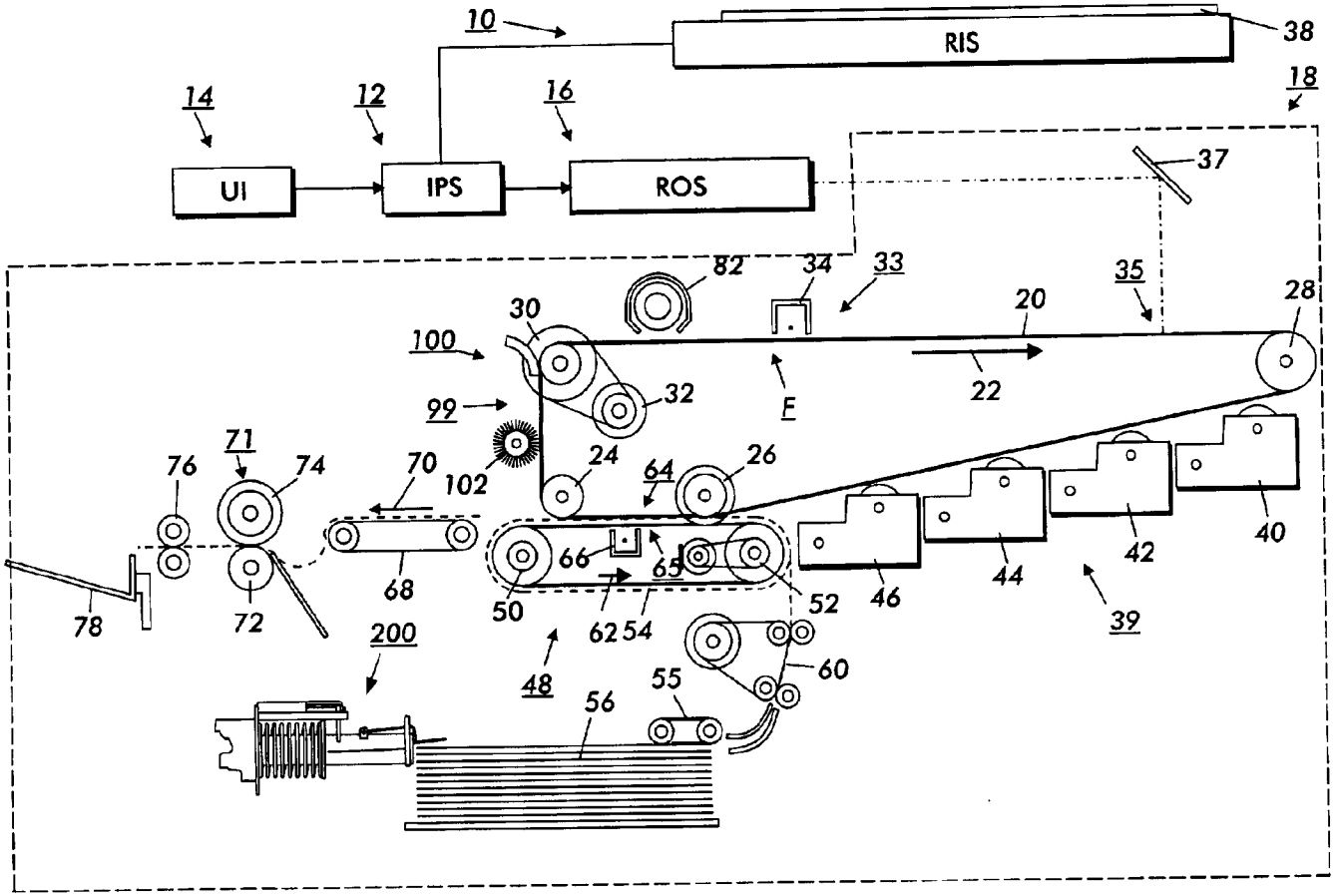
FIG. 1 is a schematic elevational view of an illustrative electrophotographic printing having the features of the present invention therein.

While the present invention will hereinafter be described in connection with preferred embodiments, it will be understood that it is not intended to limit the invention to a particular embodiment.

For a general understanding of the features of the present invention, reference is made to the drawings. In the drawings, like reference numerals have been used throughout to designate like elements. It will become evident from the following discussion that the present invention and the various embodiments set forth herein are suited for use in a wide variety of printing and copying systems, and are not necessarily limited in its application to the particular systems shown herein.

By way of a general explanation, FIG. 1 is a schematic elevational view showing an electrophotographic printing machine which incorporates features of the present invention therein. It will become evident from the following discussion that the present invention is equally well suited for use in a wide variety of copying and printing systems, and is not necessarily limited in its application to the particular system shown herein. As shown in FIG. 1, during operation of the printing system, a color or black/white original document 38 is positioned on a raster input scanner (RIS), indicated generally by the reference numeral 10. The RIS contains document illumination lamps, optics, a mechanical scanning drive, and a charge coupled device (CCD array). The RIS captures the entire image from original document 38 and converts it to a series of raster scan lines and moreover measures a set of primary color densities, i.e. red, green and blue densities, at each point of the original document. This information is transmitted as electrical signals to an image processing system (IPS), indicated generally by the reference numeral 12. IPS 12 converts the set of red, green and blue density signals to a set of colorimetric coordinates.

IPS 12 contains control electronics which prepare and manage the image data flow to a raster output scanner (ROS), indicated generally by the reference numeral 16. A user interface (UI), indicated generally by the reference numeral 14, is in communication with IPS 12. UI 14 enables an operator to control the various operator adjustable functions. The operator actuates the appropriate keys of UI 14 to adjust the parameters of the copy. UI 14 may be a touch screen, or any other suitable control panel, providing an operator interface with the system. The output signal from UI 14 is transmitted to IPS 12. IPS 12 then transmits signals corresponding to the desired image to ROS 16, which creates the output copy image. ROS 16 includes a laser with rotating polygon mirror blocks. Preferably, a nine facet polygon is used. ROS 16 illuminates, via mirror 37, the charged portion of a photoconductive belt 20 of a printer or marking engine, indicated generally by the reference numeral 18, at a rate of about 400 pixels per inch, to achieve a set of subtractive primary latent images. ROS 16 will expose the photoconductive belt 20 to record three latent images which correspond to the signals transmitted from IPS 12. One latent image is developed with cyan developer material. Another latent image is developed with magenta developer material and the third latent image is developed with yellow developer material. These developed images are transferred to a copy sheet in superimposed registration with one another to form a multicolored image on the copy sheet. This multicolored image is then fused to the copy sheet forming a color copy.

With continued reference to FIG. 1, printer or marking engine 18 is an electrophotographic printing machine. Photoconductive belt 20 of marking engine 18 is preferably made from a polychromatic photoconductive material. The photoconductive belt 20 moves in the direction of arrow 22 to advance successive portions of the photoconductive surface sequentially through the various processing stations disposed about the path of movement thereof. Photoconductive belt 20 is entrained about transfer rollers 24 and 26, tensioning roller 28, and drive roller 30. Drive roller 30 is rotated by a motor 32 coupled thereto by suitable means such as a belt drive. As roller 30 rotates, it advances belt 20 in the direction of arrow 22.

Initially, a portion of photoconductive belt 20 passes through a charging station, indicated generally by the reference numeral 33. At charging station 33, a corona generating device 34 charges photoconductive belt 20 to a relatively high, substantially uniform potential.

Next, the charged photoconductive surface is rotated to an exposure station, indicated generally by the reference numeral 35. Exposure station 35 receives a modulated light beam corresponding to information derived by RIS 10 having multicolored original document 38 positioned thereat. The modulated light beam impinges on the surface of photoconductive belt 20. The beam illuminates the charged portion of the photoconductive belt to form an electrostatic latent image. The photoconductive belt 20 is exposed three times to record three latent images thereon.

After the electrostatic latent images have been recorded on photoconductive belt 20, the belt advances such latent images to a development station, indicated generally by the reference numeral 39. The development station includes four individual developer units indicated by reference numerals 40, 42, 44, and 46. The developer units are of a type generally referred to in the art as "magnetic brush development units." Typically, a magnetic brush development system employs a magnetizable developer material including magnetic carrier granules having toner particles adhering triboelectrically thereto. The developer material is continually brought through a directional flux field to form a brush of developer material. The developer material is constantly moving so as to continually provide the brush with fresh developer material. Development is achieved by bringing the brush of developer material into contact with the photoconductive surface. Developer units 40, 42, and 44, respectively, apply toner particles of a specific color which corresponds to the compliment of the specific color separated electrostatic latent image recorded on the photoconductive surface.

The color of each of the toner particles is adapted to absorb light within a preselected spectral region of the electromagnetic wave spectrum. For example, an electrostatic latent image formed by discharging the portions of charge on the photoconductive belt 20 corresponding to the green regions of the original document will record the red and blue portions as areas of relatively high charge density on photoconductive belt 20, while the green areas will be reduced to a voltage level ineffective for development. The charged areas are then made visible by having developer unit 40 apply green absorbing (magenta) toner particles onto the electrostatic latent image recorded on photoconductive belt 20. Similarly, a blue separation is developed by developer unit 42 with blue absorbing (yellow) toner particles, while the red separation is developed by developer unit 44 with red absorbing (cyan) toner particles. Developer unit 46 contains black toner particles and may be used to develop the electrostatic latent image formed from a black and white original document. Each of the developer units is moved into and out of an operative position. In the operative position, the magnetic brush is substantially adjacent the photoconductive belt, while in the nonoperative position, the magnetic brush is spaced therefrom. (In FIG. 1, each developer unit 40, 42, 44, and 46 is shown in the operative position.) During development of each electrostatic latent image, only one developer unit is in the operative position, while the remaining developer units are in the nonoperative position. This ensures that each electrostatic latent image is developed with toner particles of the appropriate color without commingling.

After development, the toner image is moved to a transfer station, indicated generally by the reference numeral 65. Transfer station 65 includes a transfer zone, generally indicated by reference numeral 64. In transfer zone 64, the toner image is transferred to a sheet of support material, such as plain paper amongst others. At transfer station 65, a sheet transport apparatus, indicated generally by the reference numeral 48, moves the sheet into contact with photoconductive belt 20. Sheet transport 48 has a pair of spaced belts 54 entrained about a pair of substantially cylindrical rollers 50 and 52. A sheet gripper (not shown in FIG. 1) extends between belts 54 and moves in unison therewith. A sheet is advanced from a stack of sheets 56 disposed on a tray. A feeder 58 according to the present invention advances the uppermost sheet from stack 56 onto a pre-transfer transport 60. Transport 60 advances a sheet (not shown in FIG. 1) to sheet transport 48. The sheet is advanced by transport 60 in synchronism with the movement of the sheet gripper. In this way, the leading edge of the sheet arrives at a preselected position, i.e. a loading zone. As belts 54 move in the direction of arrow 62, the sheet moves into contact with the photoconductive belt 20, in synchronism with the toner image developed thereon. In transfer zone 64, a corona generating device 66 charges the backside of the sheet to the proper magnitude and polarity for attracting the toner image from photoconductive belt 20 thereto. In this way, three different color toner images are transferred to the sheet in superimposed registration with one another.

One skilled in the art will appreciate that the sheet may move in a recirculating path for four cycles when under color black removal is used. Each of the electrostatic latent images recorded on the photoconductive surface is developed with the appropriately colored toner and transferred, in superimposed registration with one another, to the sheet to form the multicolor copy of the colored original document.

After the last transfer operation, the sheet transport system directs the sheet to a vacuum conveyor 68. Vacuum conveyor 68 transports the sheet, in the direction of arrow 70, to a fusing station, indicated generally by the reference numeral 71, where the transferred toner image is permanently fused to the sheet. The fusing station includes a heated fuser roller 74 and a pressure roller 72. The sheet passes through the nip defined by fuser roller 74 and pressure roller 72. The toner image contacts fuser roller 74 so as to be affixed to the sheet. Thereafter, the sheet is advanced by a pair of rollers 76 to a catch tray 78 for subsequent removal therefrom by the machine operator.

The final processing station in the direction of movement of photoconductive belt 20, as indicated by arrow 22, is a photoreceptor cleaning station.

The sequence of operation of the sheet feeder of the present invention is as follows. A stack of paper 56 is placed into the elevator paper tray 120.

Fluffer has air opening 1. Fluffer 200 is arranged such that it may inject air between sheets in the stack and on top surface of the sheet to be fed. The air pressure between sheets helps separate sheets, i.e. puff the sheets up. The air on top of the surface of the sheet to be fed, on the other hand, due to the Venturi effect, creates a vacuum to help pull the sheet to the feeder head. The combined effects improve the speed of the sheet acquisition speed and ensure a single sheet feed.

Fluffer and orifice utilizing an air opening port 1 having a predefined cross section combined with a hinged nozzle dam 2. Papers of varying basis weight and coating behave differently in the fluff air. The lightweight sheets tend to fluff very high covering the entire cross section of the orifice while heavyweight sheets will not, often leaving a gap between the top of the stack and the top of the orifice opening. This results in a loss of valuable fluffer pressure and air volume. In the present invention, the nozzle dam will drop down in front of the orifice opening to retard a great percentage of this lost air and redirecting it back into the stack. Nozzle dam is hinged to allow it to move with the stack from a low position and blocked from moving above the upper opening of the orifice thus limited the stack fluff height.

Figure 3:
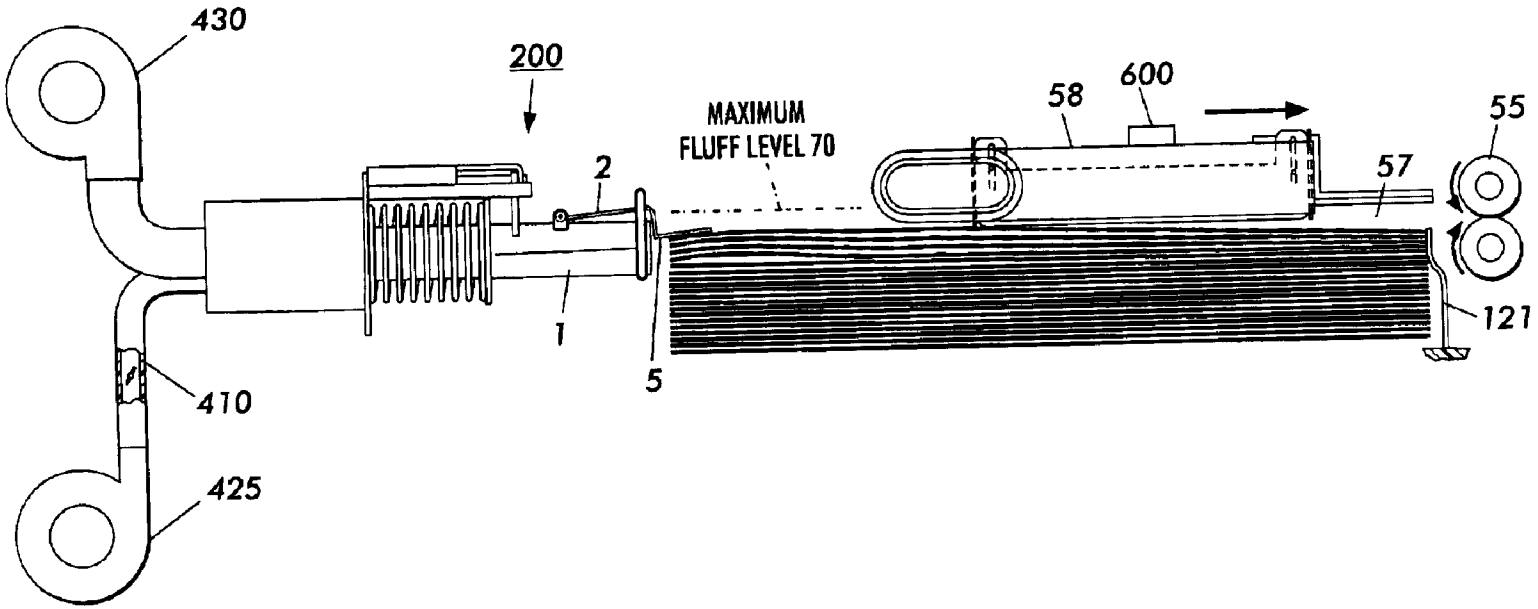
Figure 4:
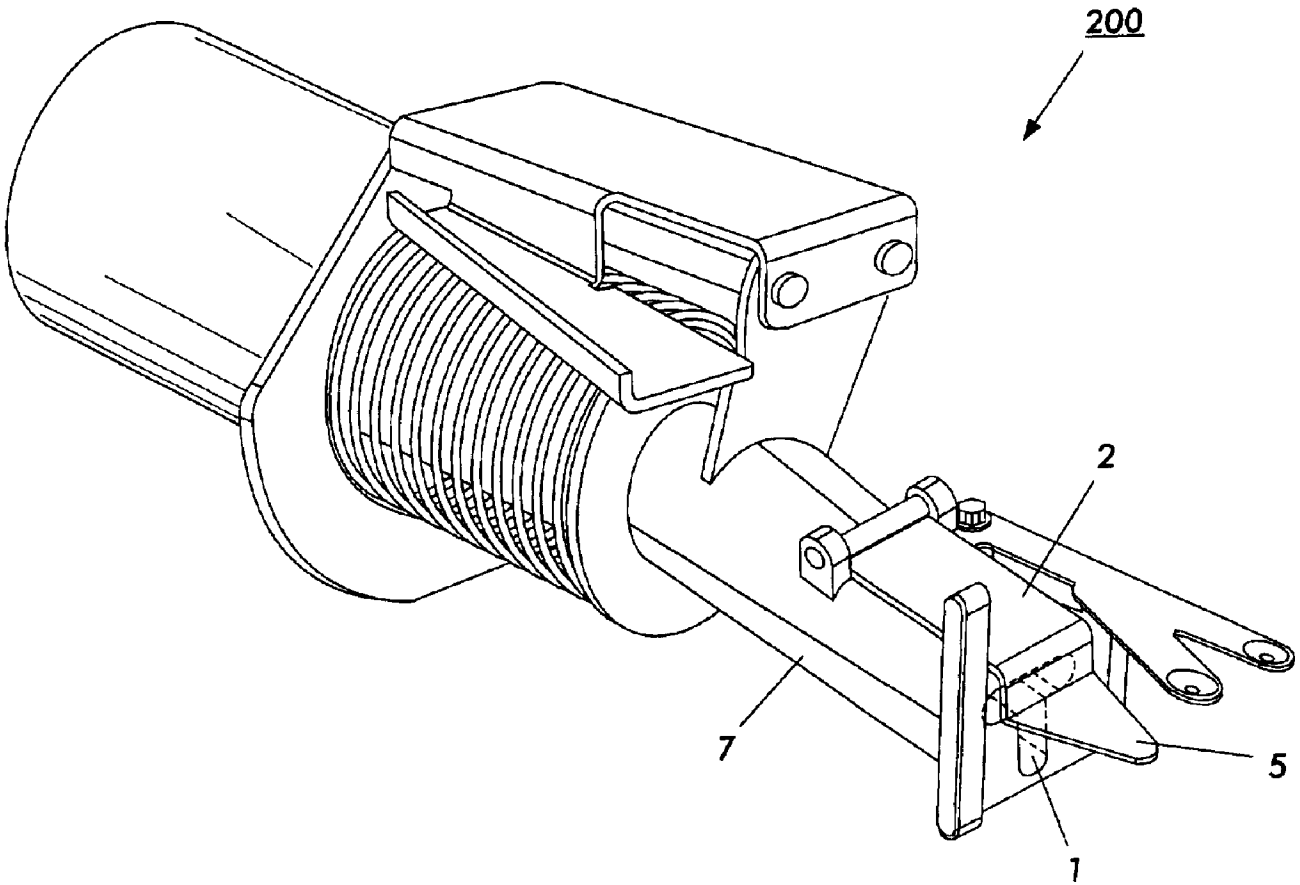

FIG. 3 illustrates the fluffing of lightweight sheets tend to fluff very high covering the entire cross section of air opening port 1, these sheets tend to over fluff over a desire fluff position 70. Nozzle dam is hinged to move with the stack from a low position and blocked from moving above the upper opening of the orifice reducing air pressure on the stack thus limited the stack fluff height to desired fluff position.

Figure 2:
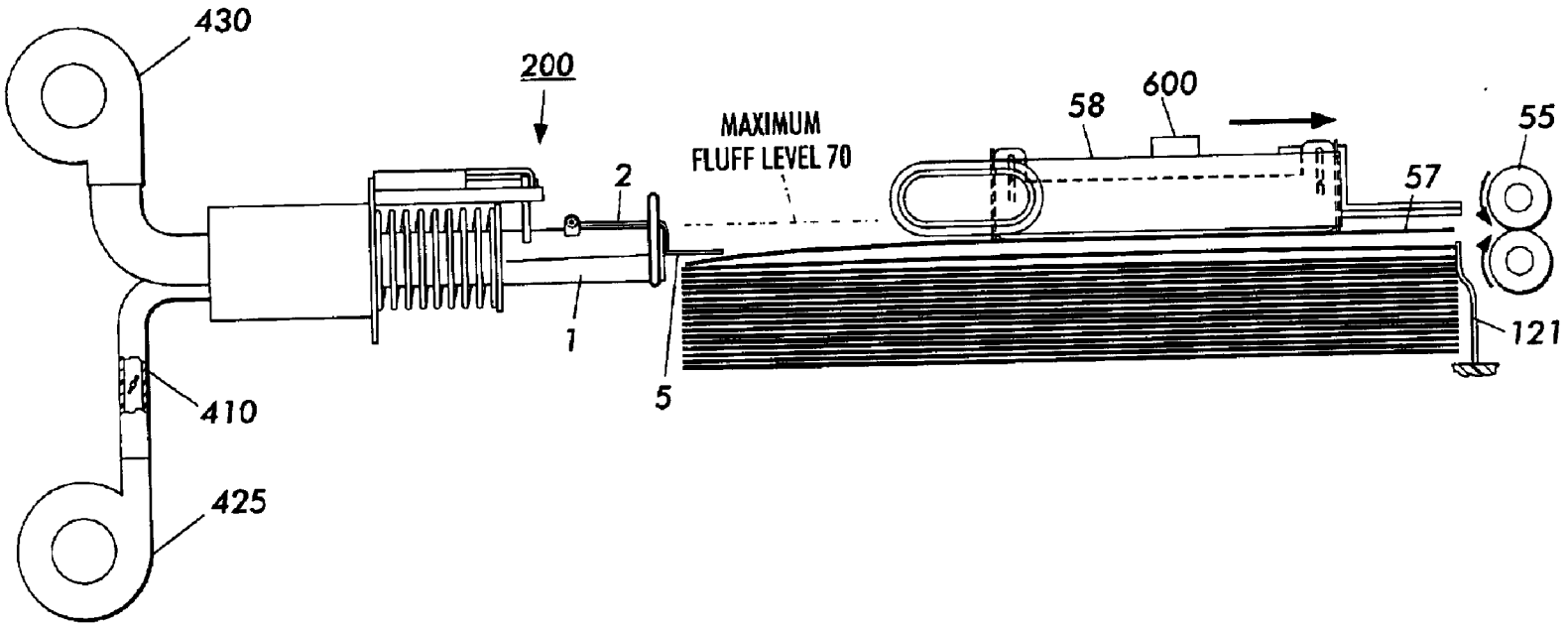
FIGS. 2–4 is a schematic of an air plenum of a media feeder employed with the present invention.

FIG. 2 illustrates the fluffing of heavyweight sheets tend to fluff low only covering lower cross section of air opening port 1. At fluffer set with nozzle dam down, the air pressure is set to allow heavy weight sheets to fluff to a desired fluff position 70.

The nozzle dam 2 is constructed of a molded ABS plastic material. It is designed to mount on top of the nozzle assembly 300 using an integral hinge pin. The top surface of the nozzle dam 2 rest normally upon the top surface of the nozzle assembly 300 with the face of the component dropping down over the orifice opening thus blocking a portion of the opening. There is mounted to the face of nozzle dam 2, a small tab 5 that rests upon the top sheet of the stack when in its proper position. The purpose of the tab 5 is to allow the nozzle dam to move up and down within its prescribed limit with the paper as it is fluffed. The length of the tab 5 allows the nozzle dam 2 to ride with the paper regardless of the relative lateral distance between of the edge of the stack and the fluffer while within its prescribed specification.

The nozzle assembly 200 consists of the nozzle body orifice nozzle dam, and pivot (not shown). The fluffer nozzle is an open face design that is positioned at some distance from the side of the paper supply stack. Air is thus directed into the side of the stack for the purpose of creating an air gap between individual sheets at the top of the paper supply stack and to provide sufficient air volume to allow the upper sheets to maintain separation until acquired and fed by the shuttle feed head. Various orifice shapes may be applied to achieve certain performance characteristics dependent upon the size of the shuttle feed head, vacuum system, relative position of the orifice to the feed head, papers size and characteristic, fluffer air pressure, air velocity and volume, feed rates, and total number of fluffer systems required and their locations around the paper supply stack.

The stack fluff height, when exposed to a constant air pressure and volume, will vary dependent upon the basis weight of the paper and the coating chemistry. Other factors affecting the height of fluff may include manufacturing and packaging process, temperature, humidity and storage methods which may contribute waviness or curl to the sheets.

Under normal conditions the lightweight sheets tend to fluff up to and above the top of the fluffer orifice while the heaviest papers may only fluff to half the height of the orifice or less. The opening at the top of the orifice provides a large leakage path for fluff air thus reducing the pressure and volume impressed into the stack to promote separation. In addition, some papers appear to form pairs, especially in heavyweight coated papers, that are difficult to separate, even with the application of heat, with a reduced fluff pressure and more difficult to maintain separation under reduced air flow.

The nozzle dam provides a method of controlling air loss from open orifice type fluffer systems especially where singular air supplies are shared between multiple fluffer and fluffer/air knife systems. The device provides better control of the fluff and reduce the need for more powerful and expensive blower systems to overcome system losses due to manufacturing tolerance and paper performance.

Referring to FIG. 3, feeder plenum 58 is located above the stack 56. The feeder plenum 58 includes a cavity which may be evacuated thereby forming a pressure differential. The difference in pressure between the inside of the feeder plenum 58 and the outside of the feeder plenum 58 draws the supply paper towards the lower paper contact surface of the feeder plenum 58 by vacuum.

Drive assembly 600 is, attached to air plenum 58 for translating the acquired sheet's leading edge 57 into feed rollers. Then, drive assembly translates air plenum in a direction of movement towards the feed rollers 55 so that a lead edge of the acquired sheet is lifted above and forward of the flange 121 and into the feed rollers 58.

Other embodiments and modifications of the present invention may occur to those skilled in the art subsequent to a review of the information presented herein; these embodiments and modifications, as well as equivalents thereof, are also included within the scope of this invention.

What is claimed is:

1. In a sheet feeding apparatus for feeding a stack of sheets in a direction of movement to a process station, comprising:

a sheet tray for holding said stack of sheets;

an air plenum, positioned above said stack of sheets, for picking up a sheet from said stack of sheets when a vacuum force in said air plenum;

a paper fluffer for blowing a constant volume of air between individual sheets in said stack to produce a fluffed stack of sheets, said paper fluffer having means for adjusting air pressure between individual sheets, said paper fluffer includes a nozzle including an outlet port for directing air into said stack, a nozzle dam pivotality mounted, relative to said outlet port, for increasing or decreasing air pressure between individual sheets, in response to the weight of an individual sheet in said stack of sheets being fluffed.

2. The apparatus of claim 1, wherein said nozzle dam partially in a first mode of operation blocks a major portion said outlet port thereby allowing a first air pressure between individual sheets for sheets requiring at least said first air pressure to be fluffed, and in a second mode of operation when said nozzle dam blocks a minor portion of said outlet thereby allowing a second air pressure between individual sheets when individual sheets are fully fluffed.

3. The apparatus of claim 2, wherein said first pressure is higher than said second pressure.

4. The apparatus of claim 1, further comprising an elevator tray for holding said stack of sheets.

5. In a sheet feeding apparatus for feeding a stack of sheets in a direction of movement to a process station, comprising:

a sheet tray for holding said stack of sheets;

an air plenum, positioned above said stack of sheets, for picking up a sheet from said stack of sheets when a vacuum force in said air plenum;

a paper fluffer for blowing a constant volume of air between individual sheets in said stack to produce a fluffed stack of sheets, said paper fluffer having means for adjusting air pressure between individual sheets, said nozzle dam partially in a first mode of operation blocks a major portion said outlet port thereby allowing a first air pressure between individual sheets for sheets requiring at least said first air pressure to be fluffed, and in a second mode of operation when said nozzle dam blocks a minor portion of said outlet thereby allowing a second air pressure between individual sheets when individual sheets are fully fluffed, said air dam includes a tab portion connected thereto in contact with said fluffed stack of sheets for moving said air dam from said first mode to said second mode.

6. A printing machine having a sheet feeding apparatus for feeding a stack of sheets in a direction of movement to a process station, comprising: a sheet tray for holding said stack of sheets;

an air plenum, positioned above said stack of sheets, for picking up a sheet from said stack of sheets when a vacuum force in said air plenum;

a paper fluffer for blowing a constant volume of air between individual sheets in said stack to produce a fluffed stack of sheets, said paper fluffer having means for adjusting air pressure between individual sheets, said paper fluffer includes a nozzle including an outlet port for directing air into said stack, a nozzle dam pivotality mounted, relative to said outlet port, for increasing or decreasing air pressure between individual sheets, in response to the weight of an individual sheet in said stack of sheets being fluffed.

7. The apparatus of claim 6, wherein said nozzle dam partially in a first mode of operation blocks a major portion said outlet port thereby allowing a first air pressure between individual sheets for sheets requiring at least said first air pressure to be fluffed, and in a second mode of operation when said nozzle dam blocks a minor portion of said outlet thereby allowing a second air pressure between individual sheets when individual sheets are fully fluffed.

8. The apparatus of claim 7, wherein said first pressure is higher than said second pressure.

9. The apparatus of claim 7, further comprising an elevator tray for holding said stack of sheets.

10. A printing machine having a sheet feeding apparatus for feeding a stack of sheets in a direction of movement to a process station, comprising: a sheet tray for holding said stack of sheets;

an air plenum, positioned above said stack of sheets, for picking up a sheet from said stack of sheets when a vacuum force in said air plenum;

a paper fluffer for blowing a constant volume of air between individual sheets in said stack to produce a fluffed stack of sheets, said paper fluffer having means for adjusting air pressure between individual sheets, said nozzle dam partially in a first mode of operation blocks a major portion said outlet port thereby allowing a first air pressure between individual sheets for sheets requiring at least said first air pressure to be fluffed, and in a second mode of operation when said nozzle dam blocks a minor portion of said outlet thereby allowing a second air pressure between individual sheets when individual sheets are fully fluffed, said air dam includes a tab portion connected thereto in contact with said fluffed stack of sheets for moving said air dam from said first mode to said second mode.

* * * * *